US008810475B2

(12) United States Patent
Maeda et al.

(10) Patent No.: US 8,810,475 B2
(45) Date of Patent: Aug. 19, 2014

(54) ANTENNA DEVICE

(75) Inventors: Tadahiko Maeda, Kusatsu (JP); Masataka Ito, Torrance, CA (US); Dongdong Wang, Torrance, CA (US); Yoshitsugu Wakazono, Torrance, CA (US); Yasuhiko Mano, Ogaki (JP)

(73) Assignees: Ibiden Co., Ltd., Ogaki-shi (JP); Ibiden USA R&D Inc., Torrance, CA (US); The Ritsumeikan Trust, Kyoto-shi (JP)

( * ) Notice: Subject to any disclaimer, the term of this patent is extended or adjusted under 35 U.S.C. 154(b) by 179 days.

(21) Appl. No.: 13/407,070

(22) Filed: Feb. 28, 2012

(65) Prior Publication Data

US 2012/0229342 A1 Sep. 13, 2012

Related U.S. Application Data

(60) Provisional application No. 61/451,754, filed on Mar. 11, 2011.

(51) Int. Cl.
*H01Q 1/36* (2006.01)
*H01Q 1/38* (2006.01)

(52) U.S. Cl.
CPC ... *H01Q 1/36* (2013.01); *H01Q 1/38* (2013.01)
USPC ..... 343/895; 343/700 MS

(58) Field of Classification Search
CPC ..... H01Q 1/36; H01Q 1/38
USPC ..... 343/700 MS, 895, 846
See application file for complete search history.

(56) References Cited

U.S. PATENT DOCUMENTS

| | | | | |
|---|---|---|---|---|
| 7,808,434 | B2 * | 10/2010 | White et al. | 343/700 MS |
| 2001/0004228 | A1 * | 6/2001 | Hirai et al. | 333/204 |
| 2004/0113752 | A1 * | 6/2004 | Schuster | 338/310 |
| 2006/0017152 | A1 * | 1/2006 | White et al. | 257/700 |
| 2006/0092079 | A1 * | 5/2006 | de Rochemont | 343/700 MS |

FOREIGN PATENT DOCUMENTS

JP 2006-121659 5/2006

OTHER PUBLICATIONS

Koga, Asanuma, Shiromoto, Okumoto, Fujimoto, and Maeda. 2008. Miniature Printed Planar UWB Antenna Using Throughholes with 5 GHz Band Rejection. Special Edition: Articles on Antenna & Propagation Technologies for High-Speed Wireless Communications. IEICE Journal B vol. J91-B No. 9: pp. 1017-1028.

* cited by examiner

*Primary Examiner* — Hoanganh Le
(74) *Attorney, Agent, or Firm* — Oblon, Spivak, McClelland, Maier & Neustadt, L.L.P.

(57) ABSTRACT

An antenna device has a substrate having a first surface and a second surface on the opposite side of the first surface, a first-surface-side conductive layer formed on the first surface of the substrate, a second-surface-side conductive layer formed on the second surface of the substrate, and through hole conductors connecting the first-surface-side conductive layer and the second-surface-side conductive layer. The first-surface-side conductive layer and the second-surface-side conductive layer are formed such that the first-surface-side conductive layer and the second-surface-side conductive layer are connected via the through hole conductors in a crank form from the first surface to second surface of the substrate.

16 Claims, 14 Drawing Sheets

ANTENNA DEVICE

CROSS-REFERENCE TO RELATED APPLICATIONS

The present application claims the benefit of priority to U.S. Application No. 61/451,754, filed Mar. 11, 2011, the entire contents of which are incorporated herein by reference.

BACKGROUND OF THE INVENTION

1. Field of the Invention

The present invention relates to an antenna device for a mobile terminal.

2. Discussion of the Background

Regarding UWB (ultra wideband) radio systems for data transmission at ultra high speed using ultra broadband from 3 to 10 G, there has been an effort to put such systems into practical use. Antennas to be loaded on UWB mobile terminals are required to be compact and lightweight, to have a planar structure for easy installation, and to feature ultra broadband properties. Furthermore, such antennas are required to show fewer fluctuations in directivity when frequencies change. Japanese Laid-Open Patent Publication 2006-121659 describes an adaptable array antenna in which multiple antenna elements are positioned on a printed wiring board to adjust its directivity. The contents of this publication are incorporated herein by reference in their entirety.

SUMMARY OF THE INVENTION

According to one aspect of the present invention, an antenna device has a substrate having a first surface and a second surface on the opposite side of the first surface, a first-surface-side conductive layer formed on the first surface of the substrate, a second-surface-side conductive layer formed on the second surface of the substrate, and multiple through hole conductors connecting the first-surface-side conductive layer and the second-surface-side conductive layer. The first-surface-side conductive layer and the second-surface-side conductive layer are formed such that the first-surface-side conductive layer and the second-surface-side conductive layer are connected via the through hole conductors in a crank form from the first surface to second surface of the substrate.

According to another aspect of the present invention, an antenna device has a substrate having a first surface and a second surface on the opposite side of the first surface, multiple first-surface-side wire portions formed on the first surface of the substrate, multiple second-surface-side wire portions formed on the second surface of the substrate, and multiple through hole conductors connecting the first-surface-side wire portions and the second-surface-side wire portions. The first-surface-side wire portions and the second-surface-side wire portions are positioned such that the first-surface-side wire portions and the second-surface-side wire portions are connected by the through hole conductors in a helical form between the first surface and second surface of the substrate.

According to yet another aspect of the present invention, an antenna device has multiple insulation layers including a first insulation layer having a first surface and a second surface on the opposite side of the first surface, a second insulation layer laminated on a first-surface side of the first insulation layer, a third insulation layer laminated on a second-surface side of the first insulation layer, multiple conductive layers including a first conductive layer formed on the first-surface side of the first insulation layer, a second conductive layer formed on the second-surface side of the first insulation layer, a third conductive layer formed on the second insulation layer on the opposite side of the first insulation layer, a fourth conductive layer formed on the third insulation layer on the opposite side of the first insulation layer, and multiple via conductors including a via conductor formed through the first insulation layer and connecting the first conductive layer and the second conductive layer, a via conductor formed through the first insulation layer and a via conductor formed through the second insulation layer such that the second conductive layer is connected to the third conductive layer, and a via conductor formed through the second insulation layer, a via conductor formed through the first insulation layer and a via conductor formed through the third insulation layer such that the third conductive layer is connected to the fourth conductive layer. The first conductive layer, the second conductive layer, the third conductive layer and the fourth conductive layer are positioned and connected via the via conductors such that the first conductive layer, the second conductive layer, the third conductive layer, the fourth conductive layer and the via conductors form a spiral form.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
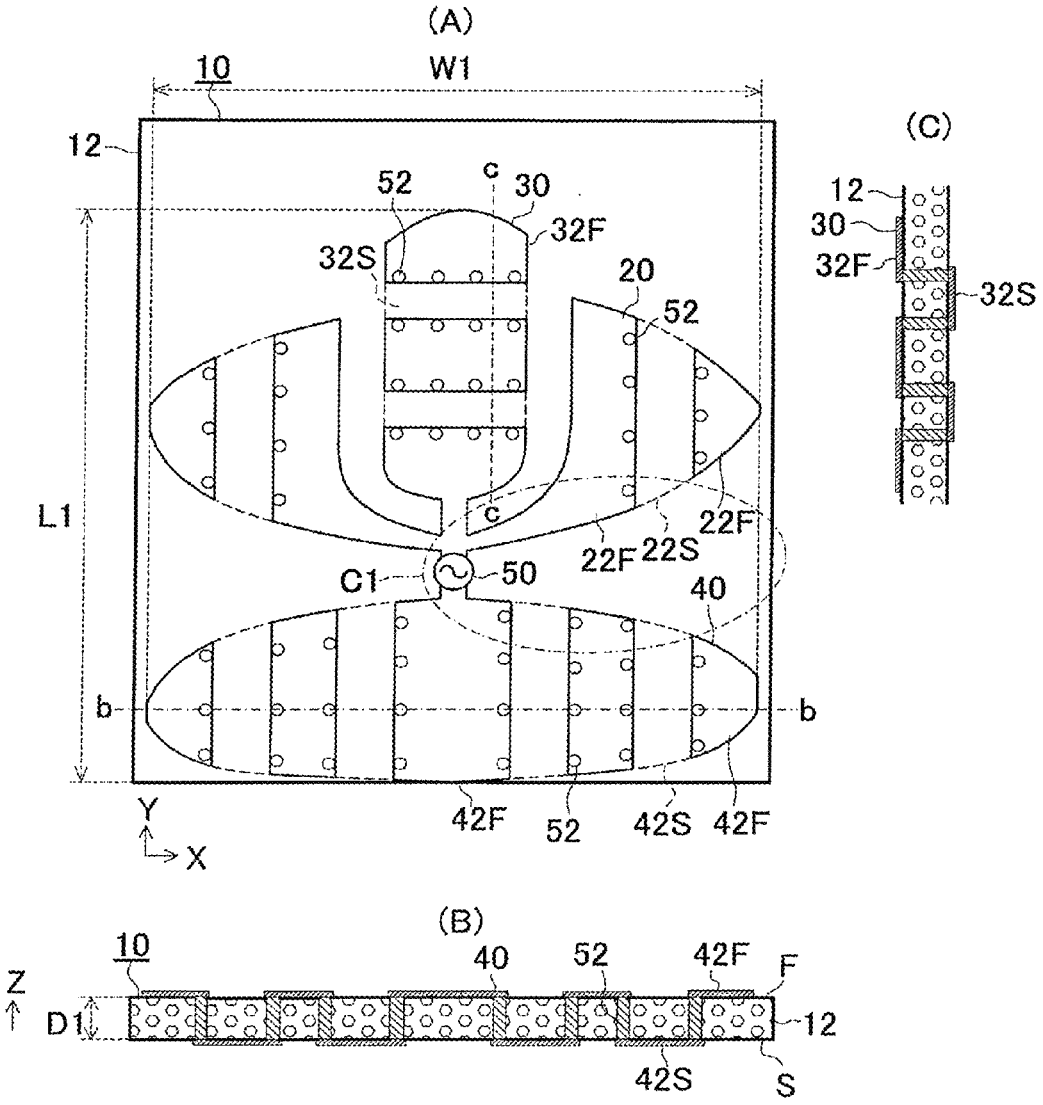
FIG. 1(A) is a plan view of an antenna device according to the first embodiment.
FIG. 1(B) is a cross-sectional view at the b-b line in FIG. 1(A)
FIG. 1(C) is a cross-sectional view at the c-c line in FIG. 1(A)

The embodiments will now be described with reference to the accompanying drawings, wherein like reference numerals designate corresponding or identical elements throughout the various drawings.

First Embodiment

Figure 2:
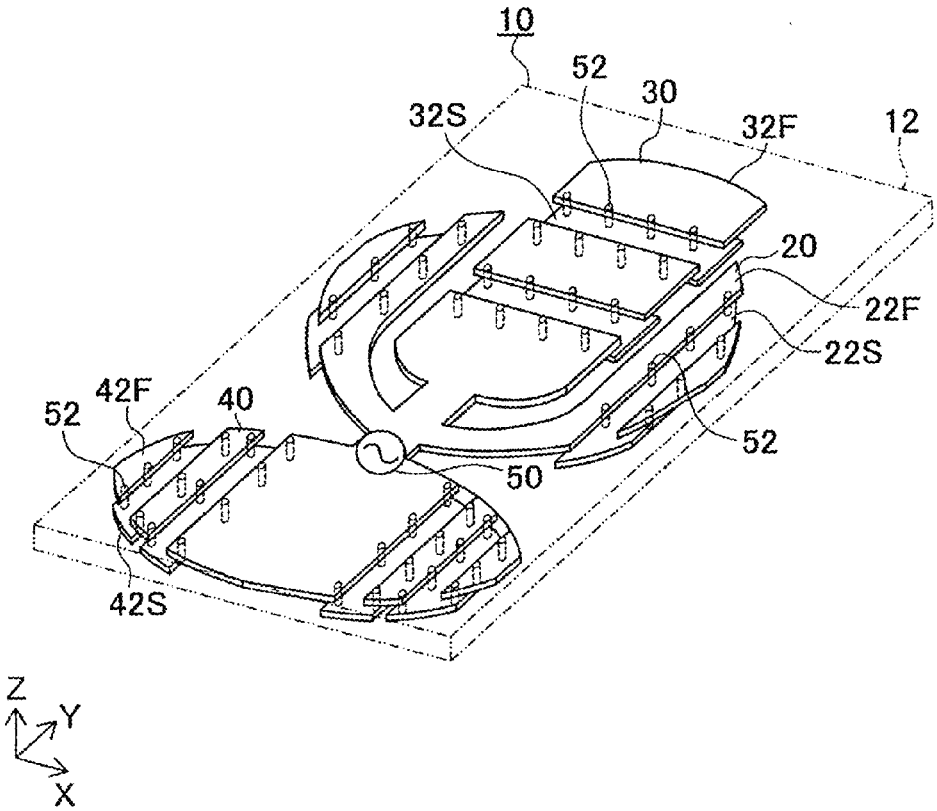
FIG. 2 is a perspective view of the antenna device according to the first embodiment.

An antenna device according to the first embodiment of the present invention is described with reference to FIGS. 1~3. FIG. 1(A) is a plan view of an antenna device of the first embodiment, FIG. 1(B) is a cross-sectional view at the b-b line in FIG. 1(A), and FIG. 1(C) is a cross-sectional view at the c-c line in FIG. 1(A). FIG. 2 is a perspective view of an antenna element of the antenna device. The antenna device is formed by arranging an antenna element in printed wiring board 12. An antenna element includes longitudinal radiation element 30, lateral radiation element 20 and ground element 40. Longitudinal radiation element 30 and lateral radiation element 20 are connected to an end of feed point 50, and ground element 40 is connected to the other end of feed point 50. Power is supplied to the feed point through a 50-ohm coplanar line, which is not shown in the drawings. Here, instead of a coplanar line, a microstrip line may also be used.

As the cross-sectional view in FIG. 1(B) shows, ground element 40 is formed in a crank form by using through hole 52 to connect substantially rectangular conductive cell (42F) on the upper-surface (F) side and substantially rectangular conductive cell (42S) on the lower-surface (S) side. In the same manner, lateral radiation element 20 is formed in a lateral crank form by using through hole 52 to connect trapezoidal conductive cell (22F) on the upper-surface (F) side and substantially trapezoidal conductive cell (22S) on the lower-surface (S) side. Longitudinal radiation element 30 is formed in a longitudinal crank form by using through hole 52 to connect substantially rectangular conductive cell (32F) on the upper-surface (F) side and substantially rectangular conductive cell (32S) on the lower-surface (S) side. Here, longitudinal Y and lateral X are relative, and a lateral direction Y indicates a direction perpendicular to a longitudinal direction X. A longitudinal direction means one direction, and it does not necessarily correspond to the longitudinal and lateral directions of printed wiring board 12.

An antenna element is formed to have width (W1) at 14.2 mm, length (L1) at 29.4 mm and thickness (D1) at 1 mm. An antenna element may be formed inside a transmitter/receiver substrate for mounting an electronic component. Alternatively, a compact printed wiring board (antenna device) formed only with an antenna element may be connected to or loaded on a transmitter/receiver substrate.

In antenna device 10 of the first embodiment, since an antenna element is formed by positioning multiple conductive cells on the upper-surface (F) side, through holes 52 and one or more conductive cells on the lower-surface (S) side in a crank form seen at a cross section, it is made compact compared with an antenna device in which an antenna element is positioned only on an upper surface. Since such an antenna is formed using technology for manufacturing printed wiring boards, such antennas are manufactured at low cost. Also, since such an antenna is accommodated in a printed wiring board, it is easy for the antenna to be built into a mobile terminal.

In addition, broadband properties are achieved by forming the antenna element in a crank form seen at a cross section. Namely, when impedance properties and VSWR properties were calculated and measured in comparison with a planar antenna element, which is enlarged in a lateral direction by unfolding the through-hole crank portions so as not to have a folded structure, the calculation result was substantially the same as the measurement result, and the following was confirmed: regarding the folded structure, in the antenna element which is folded into a crank form according to the first embodiment, the VSWR was approximately 2 or less when the frequency range was 3.5 GHz to 10.6 GHz. Based on the above result, it is found that VSWR properties are improved and broadband properties are achieved by using the structure folded into a crank form.

Figure 3:
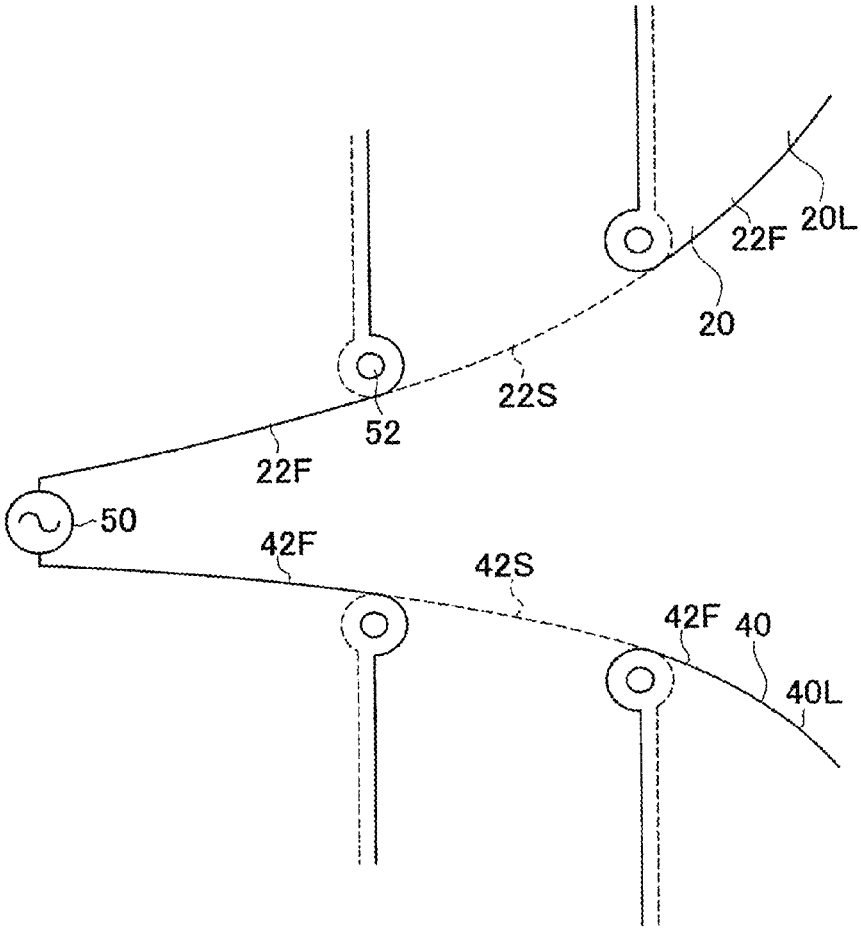
FIG. 3 is a view to illustrate electrical characteristics of an antenna element.

FIG. 3 is a view to illustrate electrical characteristics in the section surrounded by circle (C1) in FIG. 1. In an antenna device according to the first embodiment, each side of conductive cells (22F, 22S, 22F) formed continuously on the upper-surface (F) side and the lower-surface (S) side of lateral radiation element 20 is positioned along curved line (20L). In the same manner, each side of conductive cells (42F, 42S, 42F) formed continuously on the upper-surface (F) side and the lower-surface (S) side of ground element 40 is positioned along curved line (40L). Then, the distance is set to increase between curved line (20L) connecting conductive cells of lateral radiation element 20 and curved line (40L) connecting conductive cells of ground element 40 as they are extended farther from the feed point.

Here, at a high frequency that exceeds 5 GHz, it was found that between a side (curved line 20L) of lateral radiation element 20 facing the ground element and a side (curved line 40L) of ground element 40 facing the radiation element, a waveguide is formed equivalently to determine characteristic impedance. Therefore, by setting those sides as curved lines (20L, 40L), and further setting those lines to have a gradually greater distance, a widening waveguide with a tapered shape is formed. Accordingly, characteristic impedance changes continuously in response to frequencies, and broadband properties are achieved. Moreover, fluctuations in directivity are minimized when frequencies change. Here, it is also an option for conductive cells (22F, 22S, 42F, 42S) each to be formed in a rectangular shape so that the shorter sides of such rectangles are positioned along straight lines.

Moreover, in an antenna device according to the first embodiment, the lines extended from the upper and lower bases of trapezoidal conductive cells (22F, 22S, 22F) of lateral radiation element 20 respectively overlap the long sides of substantially rectangular conductive cells (42F, 42S, 42F) of ground element 40. Accordingly, characteristic impedance changes continuously in response to frequencies, and broadband properties are achieved.

First Modified Example of the First Embodiment

Figure 4:
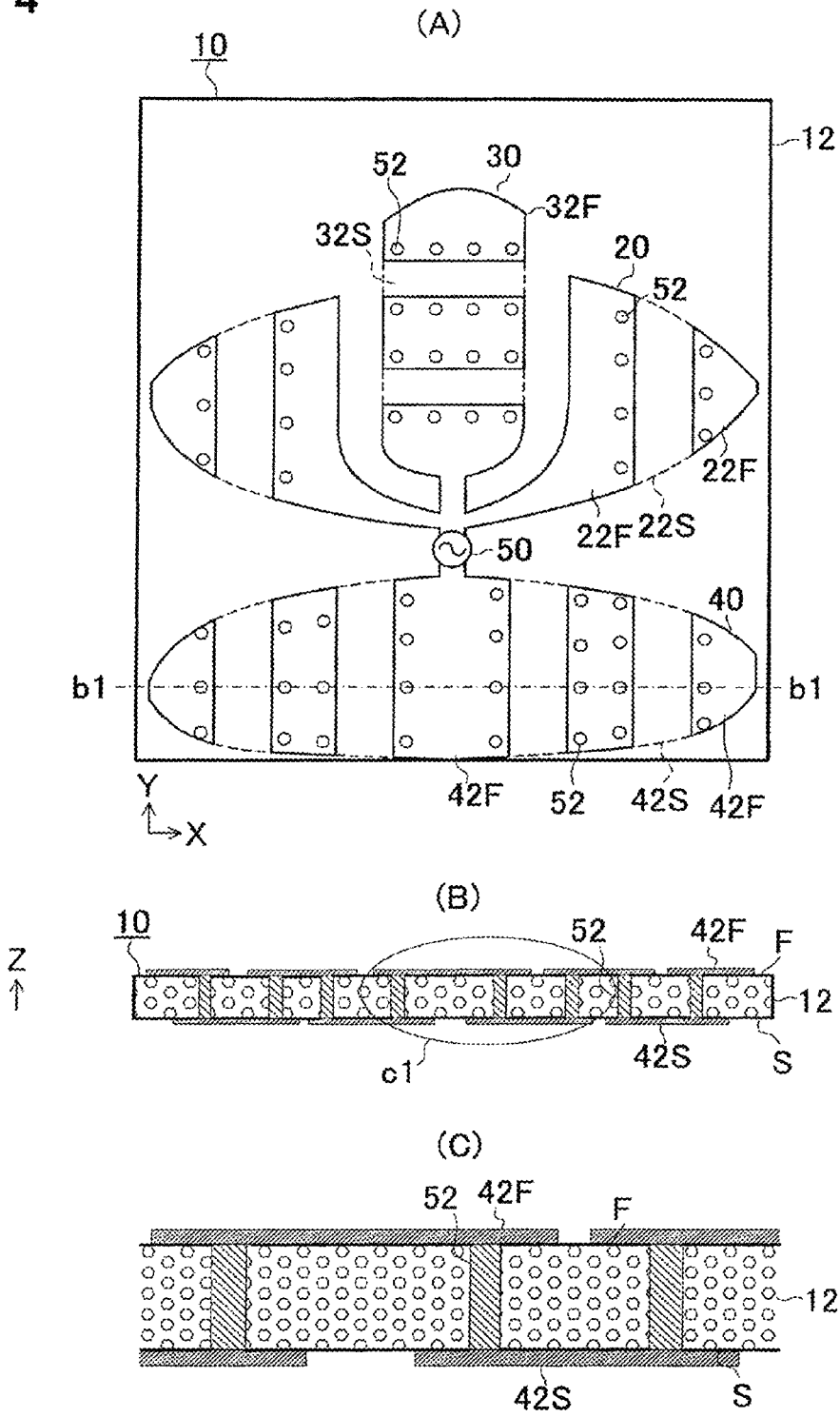
FIG. 4(A) is a plan view of an antenna device according to the first modified example of the first embodiment.
FIG. 4(B) is a cross-sectional view at the b1-b1 line in FIG. 4(A)
FIG. 4(C) is a magnified view of ellipse (c1) in FIG. 4(B)

By referring to FIG. 4, an antenna device is described according to the first modified example of the first embodiment of the present invention. FIG. 4(A) is a plan view of an antenna device according to the first modified example of the first embodiment; FIG. 4(B) is a cross-sectional view at the b1-b1 line in FIG. 4(A); and FIG. 4(C) is a magnified view of ellipse (c1) in FIG. 4(B). The same as in the first embodiment, in the antenna device according to the first modified example of the first embodiment, the antenna element includes longitudinal radiation element 30, lateral radiation element 20 and ground element 40. However, in the first modified example of the first embodiment, conductive cells (42S, 42F) of ground element 40 are extended beyond through holes 52 toward their respective adjacent conductive cells, providing conductance between adjacent conductive layers. Conductive cells (22S, 22F) of lateral radiation element 20 are formed in the same manner. Since the amount of conductance is adjusted by cutting the extended portions of conductive cells by trimming or the like, it is easy to adjust the antenna properties in each antenna device unit. According to the first modified example of the first embodiment, the space to an edge of a conductor is enlarged by the extended conductor (land), thus making it easy to form a through hole.

Second Modified Example of the First Embodiment

Figure 5:
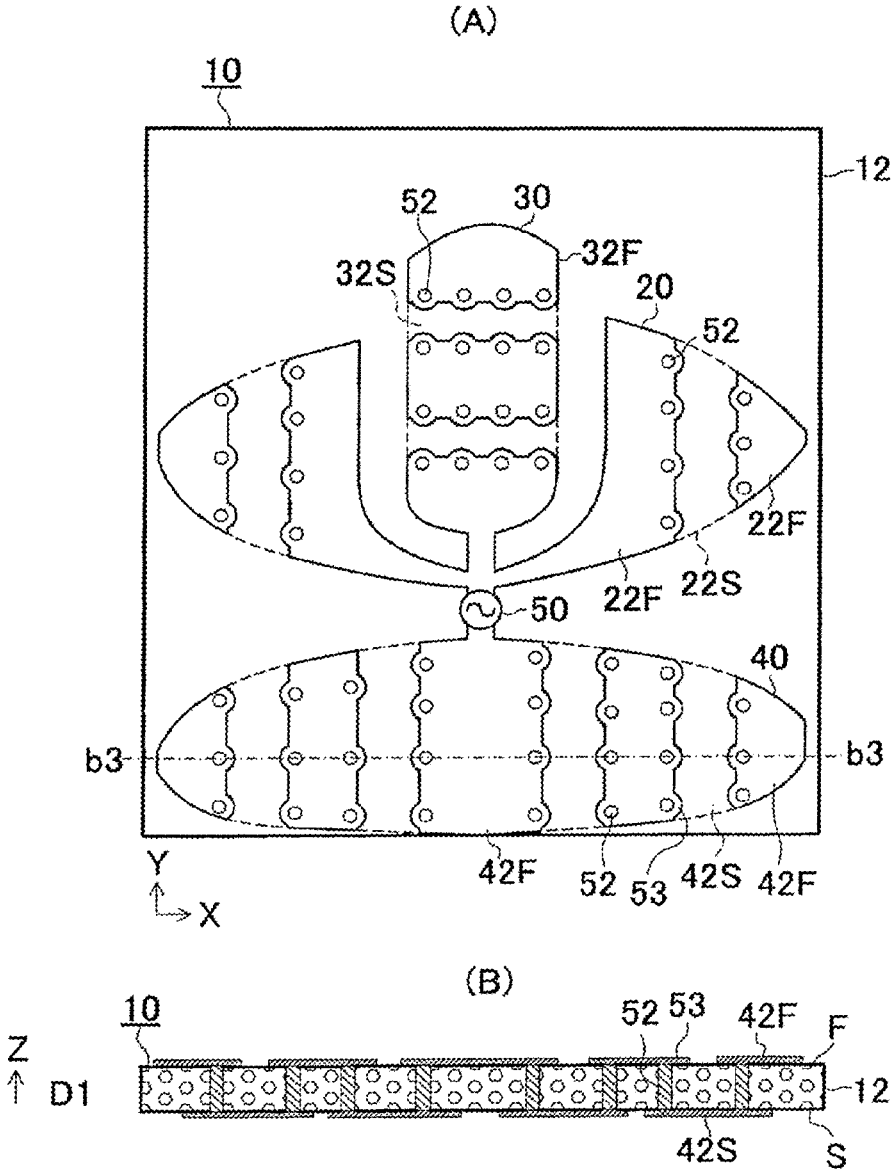
FIG. 5(A) is a plan view of an antenna device according to the second modified example of the first embodiment.
FIG. 5(B) is a cross-sectional view at the b3-b3 line in FIG. 5(A)

The second modified example of the first embodiment is described with reference to FIG. 5. FIG. 5(A) is a plan view of an antenna device according to the second modified example of the first embodiment, and FIG. 5(B) is a cross-sectional view at the b3-b3 line in FIG. 5(A). In the second modified example of the first embodiment, from the long sides of substantially rectangular conductive cells (42S, 42F) of ground element 40, as well as from the upper and lower bases of substantially trapezoidal conductive cells (22S, 22F) of lateral radiation element 20, land portions 53 of through holes protrude toward their respective sides. In the second modified example of the first embodiment, it is easy to form through holes because of protruding land portions. The same applies to longitudinal radiation element 30.

Third Modified Example of the First Embodiment

Figure 6:
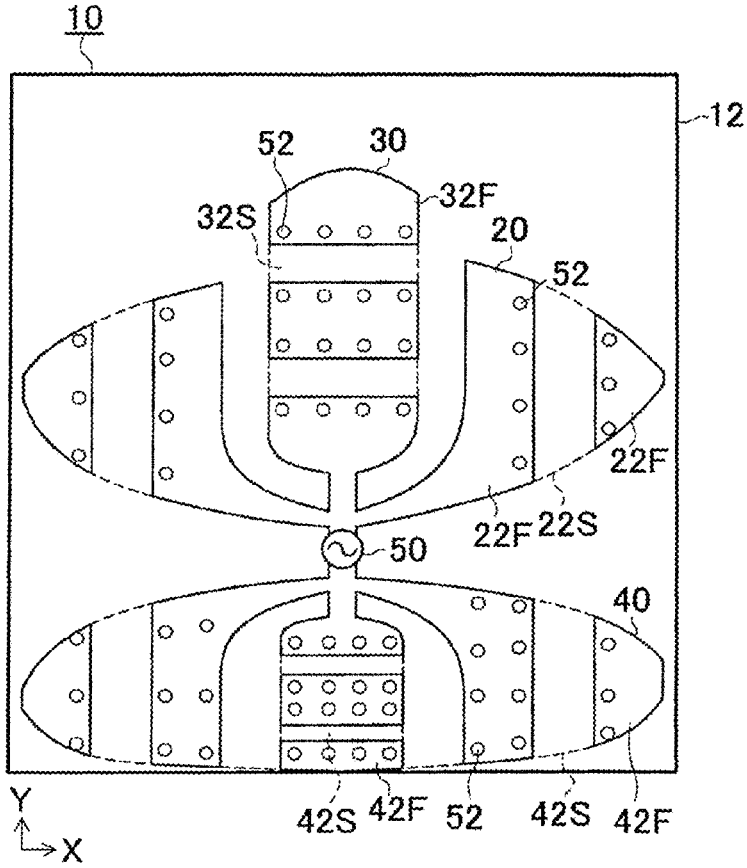
FIG. 6 is a plan view of an antenna device according to the third modified example of the first embodiment.

The third modified example of the first embodiment is described with reference to FIG. 6. FIG. 6 is a plan view of an antenna device according to the third modified example of the first embodiment. According to the third modified example of the first embodiment, in a section of the ground element corresponding to longitudinal radiation element 30, substantially rectangular conductive cells (42S, 42F) are positioned in a longitudinal crank form.

Second Embodiment

Figure 7:
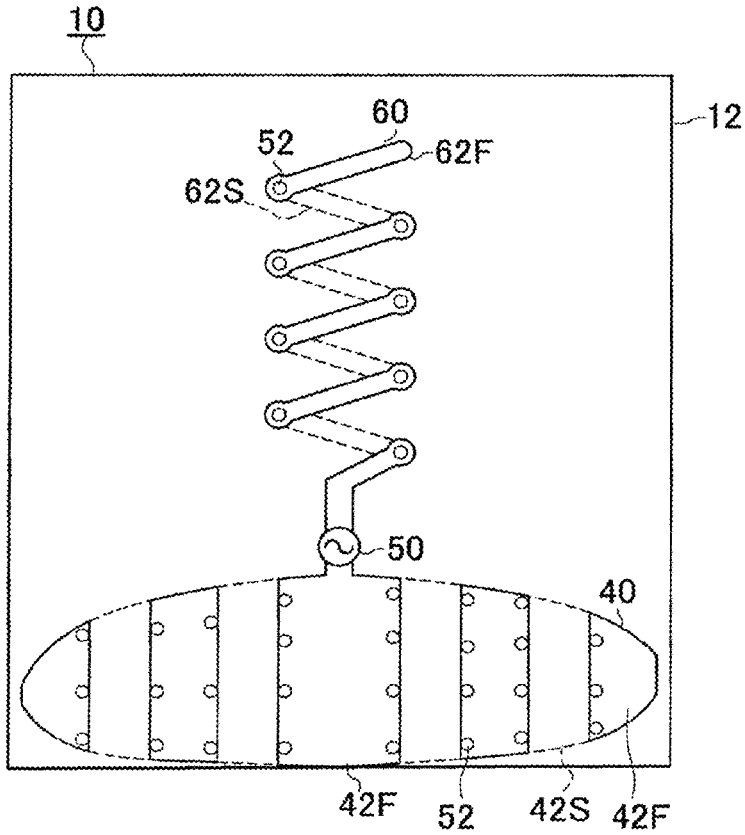
FIG. 7 is a plan view of an antenna device according to the second embodiment.

An antenna device is described according to the second embodiment of the present invention by referring to FIG. 7. The antenna element of the second embodiment includes helical radiation element 60 and ground element 40. Ground element 40 is formed in a substantially rectangular shape, the same as in the first embodiment, and helical radiation element 60 is positioned in a direction perpendicular to a long side of substantially rectangular ground element 40.

In the second embodiment, helical radiation element 60 is formed by using through holes 52 to connect multiple conductive wire portions (62F) on the upper-surface side and multiple conductive wire portions (62S) on the lower-surface side in a helical form. Helical radiation element 60 allows the antenna to operate as a normal-mode helical antenna. Since the antenna is self resonant at each loop, the antenna operates at low frequencies. Accordingly, a helical antenna is formed in a planar printed wiring board and such an antenna device is made compact. Since such an antenna is formed using technology for manufacturing printed wiring boards, such antennas are manufactured at low cost.

Modified Example of the Second Embodiment

Figure 8:
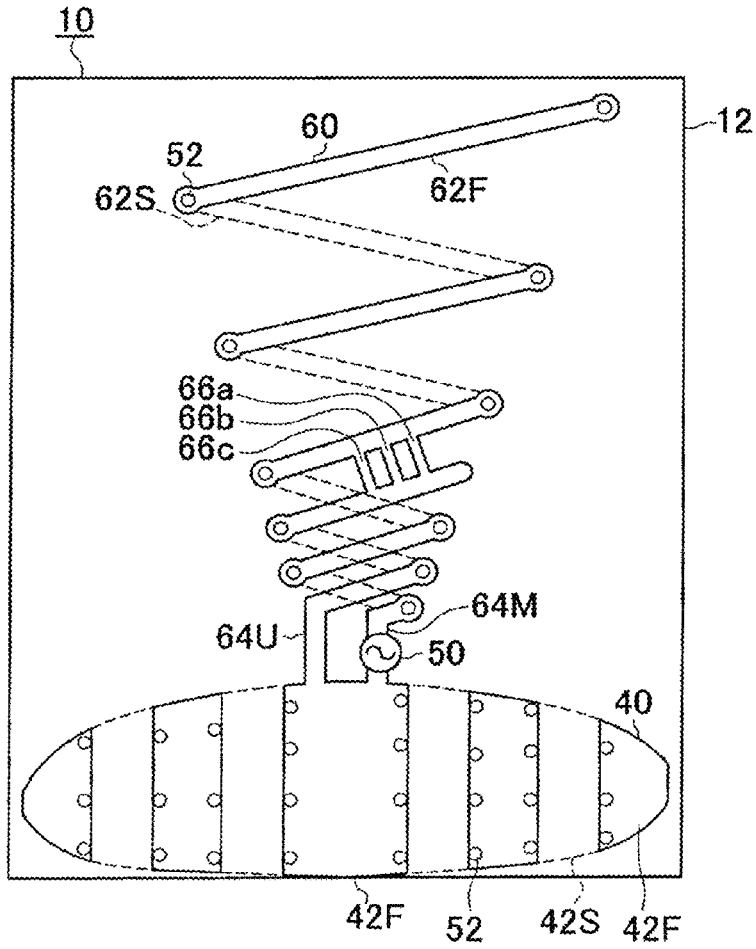
FIG. 8 is a plan view of an antenna device according to a modified example of the second embodiment.

An antenna device according to a modified example of the second embodiment of the present invention is described with reference to FIG. 8. An antenna element according to the modified example of the second embodiment has helical radiation element 60 and ground element 40 the same as in the second embodiment. Ground element 40 is shaped substantially rectangular the same as in the first embodiment, and helical radiation element 60 is positioned in a direction perpendicular to a long side of substantially rectangular ground element 40.

In the modified example of the second embodiment, helical radiation element 60 is made up of primary element (64M) connected to feed point 50 and turn-back element (64U) connected to ground element 40. Turn-back element (64U) is connected to primary element (64M) at multiple short-circuiting points (66*a*, 66*b*, 66*c*). Although a normal-mode helical antenna is self resonant, its radiation resistance is usually low. Thus, by forming part of the helical radiation element to be folded, the impedance is adjusted, allowing an easy adjustment of properties. In addition, since multiple removable short-circuiting points are included, the properties are easily adjusted by removing any of short-circuiting points (66*a*, 66*b*, 66*c*) by laser trimming. Ground element 40 may also be formed as a helical ground element.

Third Embodiment

Figure 9:
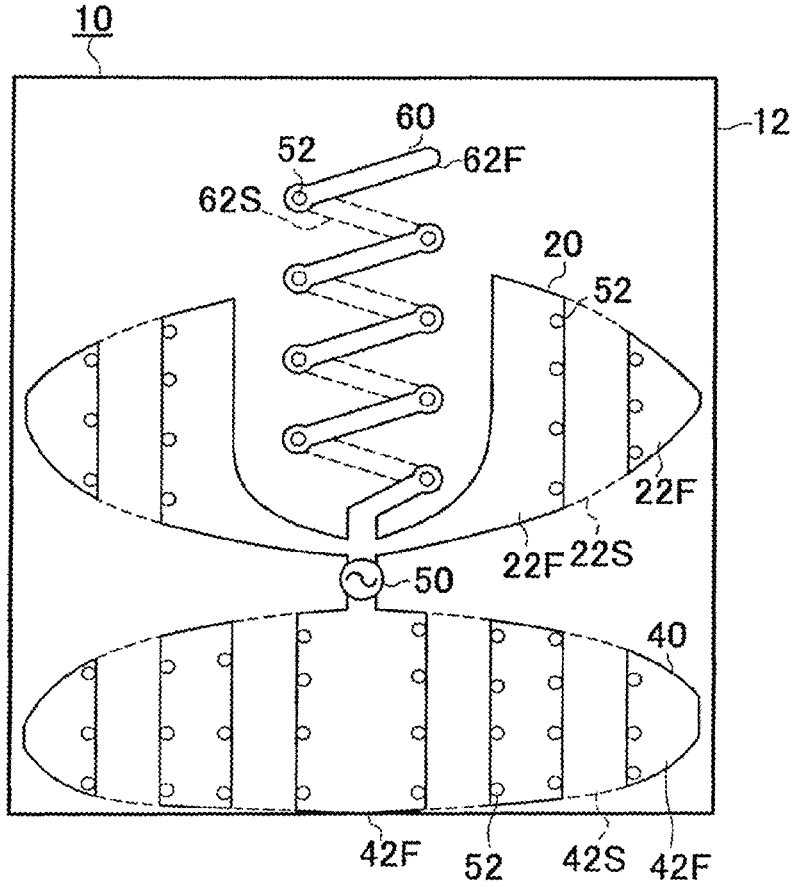
FIG. 9 is a plan view of an antenna device according to the third embodiment.

An antenna device according to the third embodiment of the present invention is described by referring to FIG. 9. An antenna element of the third embodiment includes helical radiation element 60, the same as in the second embodiment, and lateral radiation element 20 and ground element 40, the same as in the first embodiment.

As described above with reference to the first embodiment, by positioning lateral radiation element 20 in such a way that the distance gradually increases between a side of lateral radiation element 20 facing the ground element and a side of ground element 40 facing the radiation element side, a widening waveguide with a tapered shape is formed. Thus, characteristic impedance continuously changes in response to frequencies, and broadband properties for high frequencies are achieved. Meanwhile, helical radiation element 60 allows the antenna to operate at low frequencies. Thus, the antenna is made compact due to its folded structure while responding to a wide range of frequencies. In the antenna device according to the third embodiment, it is also preferable that helical radiation element 60 is formed to have primary element (64M), the same as in the modified example of the second embodiment, and ground element 40.

Modified Example of the Third Embodiment

Figure 10:
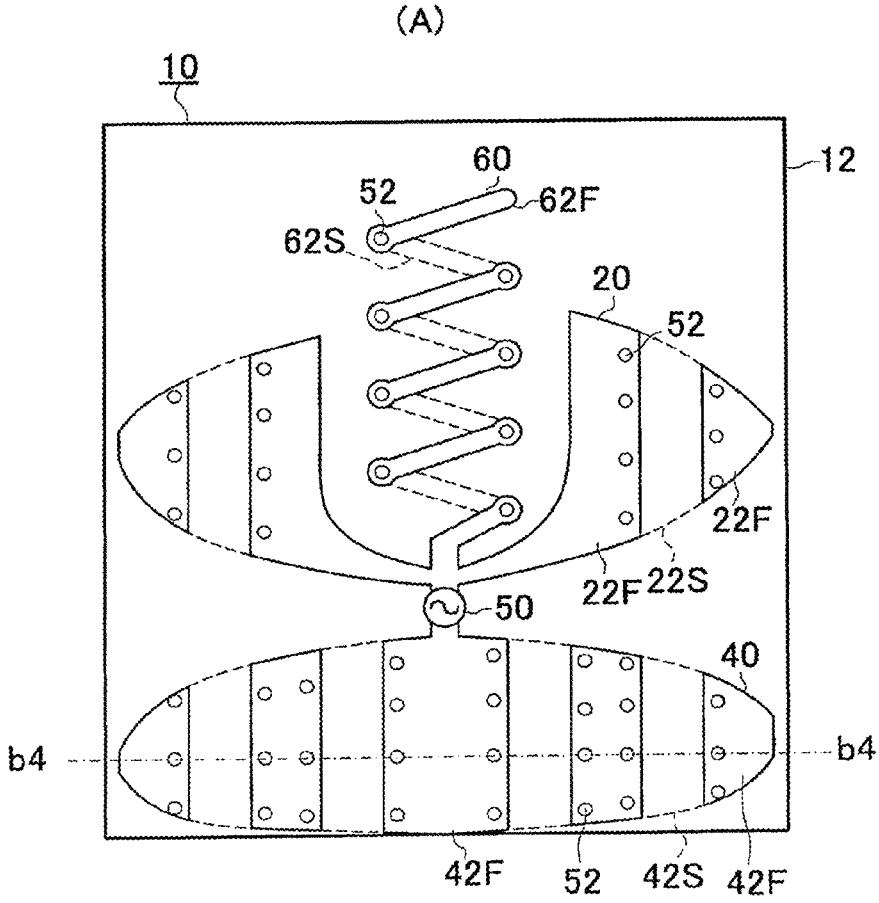
FIG. 10(A) is a plan view of an antenna device according to a modified example of the third embodiment.
FIG. 10(B) is a cross-sectional view at the b4-b4 line in FIG. 10(A)
Figure 10:
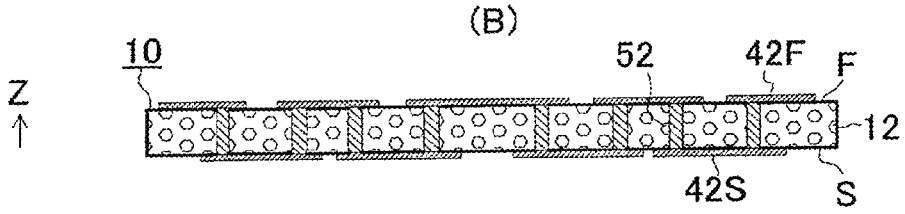

By referring to FIG. 10, an antenna device according to a modified example of the third embodiment of the present invention is described. FIG. 10(A) is a plan view of an antenna device according to the modified example of the third embodiment, and FIG. 10(B) is a cross-sectional view at the "b4-b4" line in FIG. 10(A). In the modified example of the third embodiment, conductive cells (42S, 42F) of ground element 40 are extended beyond through holes 52 toward their respective adjacent conductive cells to provide conductance between adjacent conductive layers the same as in the first modified example of the first embodiment. Conductive cells (22S, 22F) of lateral radiation element 20 are formed in the same manner. Since the amount of conductance is adjusted by cutting the extended portions of conductive cells by trimming or the like, it is easy to adjust the antenna properties in each antenna device unit. According to the modified example of the third embodiment, the space toward an edge of a conductor is enlarged by the extended conductor (land), thus making it easy to form a through hole.

Fourth Embodiment

Figure 11:
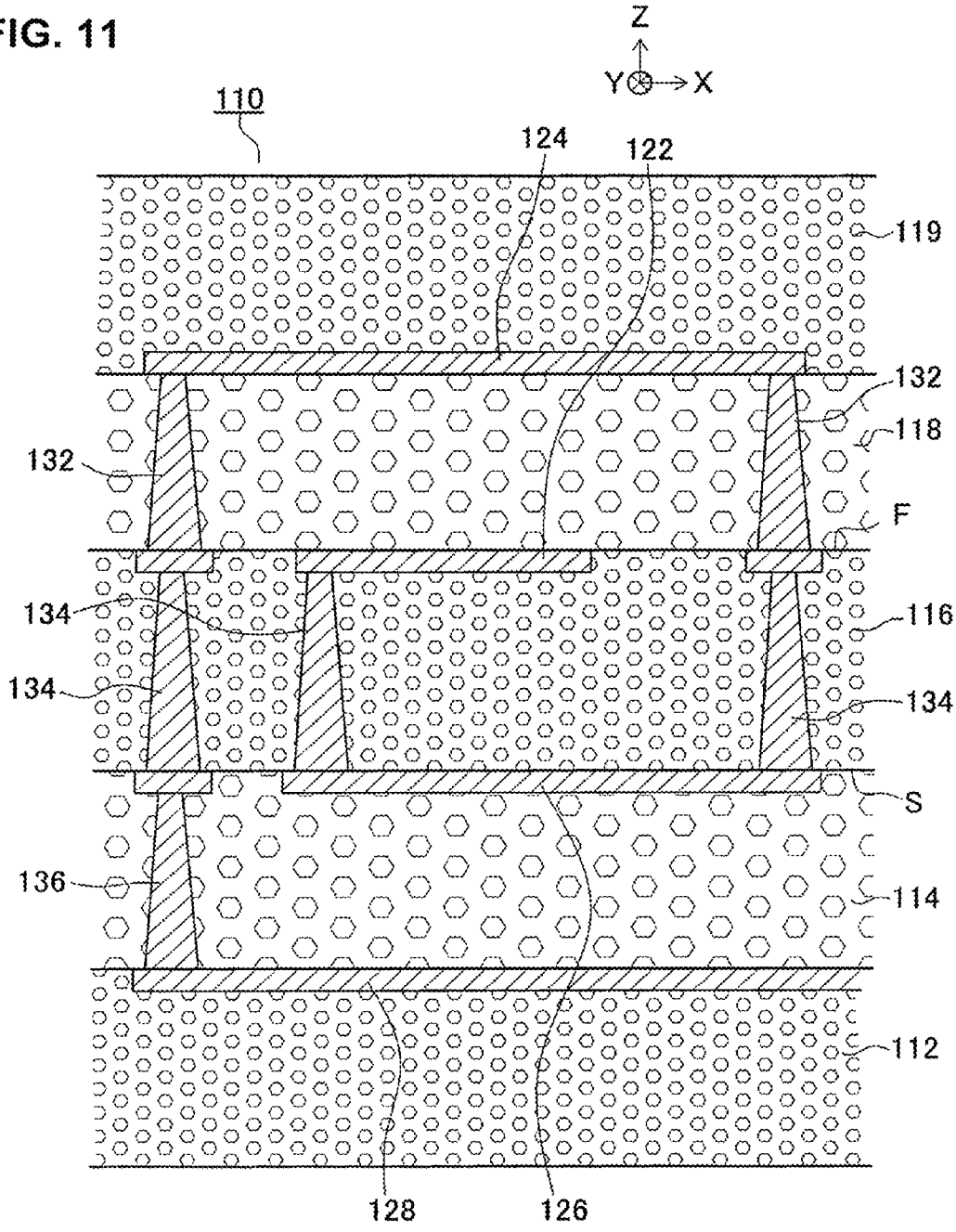
FIG. 11 is a cross-sectional view of an antenna device according to the fourth embodiment.

The fourth embodiment is described by referring to FIG. 11. FIG. 11 shows a cross-sectional view of an antenna device. The antenna device is formed in a laminated printed wiring board made by laminating five resin insulation layers (112, 114, 116, 118, 119). Second insulation layer 118 is laminated on the upper-surface (F) side of first insulation layer 116 in the center, third insulation layer 114 is laminated on the lower-surface (S) side of first insulation layer 116, fourth insulation layer 119 is laminated on the upper-surface side of second insulation layer 118, and fifth insulation layer 112 is laminated on the lower-surface side of third insulation layer 114.

Antenna element 110 includes the following: first conductive layer 122 positioned on the upper-surface (F) side of first insulation layer 116; second conductive layer 126 positioned on the lower-surface (S) side of first insulation layer 116; third conductive layer 124 positioned on a surface of second insulation layer 118 that is opposite the surface facing the first insulation layer; fourth conductive layer 128 positioned on a surface of third insulation layer 114 that is opposite the surface facing the first insulation layer; via conductor 134 in the first insulation layer that connects first conductive layer 122 and second conductive layer 126; via conductor 134 in the first insulation layer and via conductor 132 in the second insulation layer that connect second conductive layer 126 and third conductive layer 124; and via conductor 132 in the second insulation layer, via conductor 134 in the first insulation layer and via conductor 136 in the third insulation layer that connect third conductive layer 124 and fourth conductive layer 128. Then, antenna element 110 is formed by arranging the following in a spiral form: first conductive layer 122, via conductor 134, second conductive layer 126, via conductors (134, 132), third conductive layer 124, via conductors (132, 134, 136) and fourth conductive layer 128.

In the antenna device according to the fourth embodiment, a spiral antenna element is formed by positioning in a spiral form a first conductive layer, a second conductive layer, a third conductive layer, a fourth conductive layer and via conductors in regard to insulation layers of a laminated printed wiring board. Since a spiral antenna element is made compact and is formed using technology for manufacturing printed wiring boards, such antennas are manufactured at low cost. Spiral radiation element 110 allows the antenna to be self resonant at each loop and to operate at low frequencies.

Modified Example of the Fourth Embodiment

Figure 12:
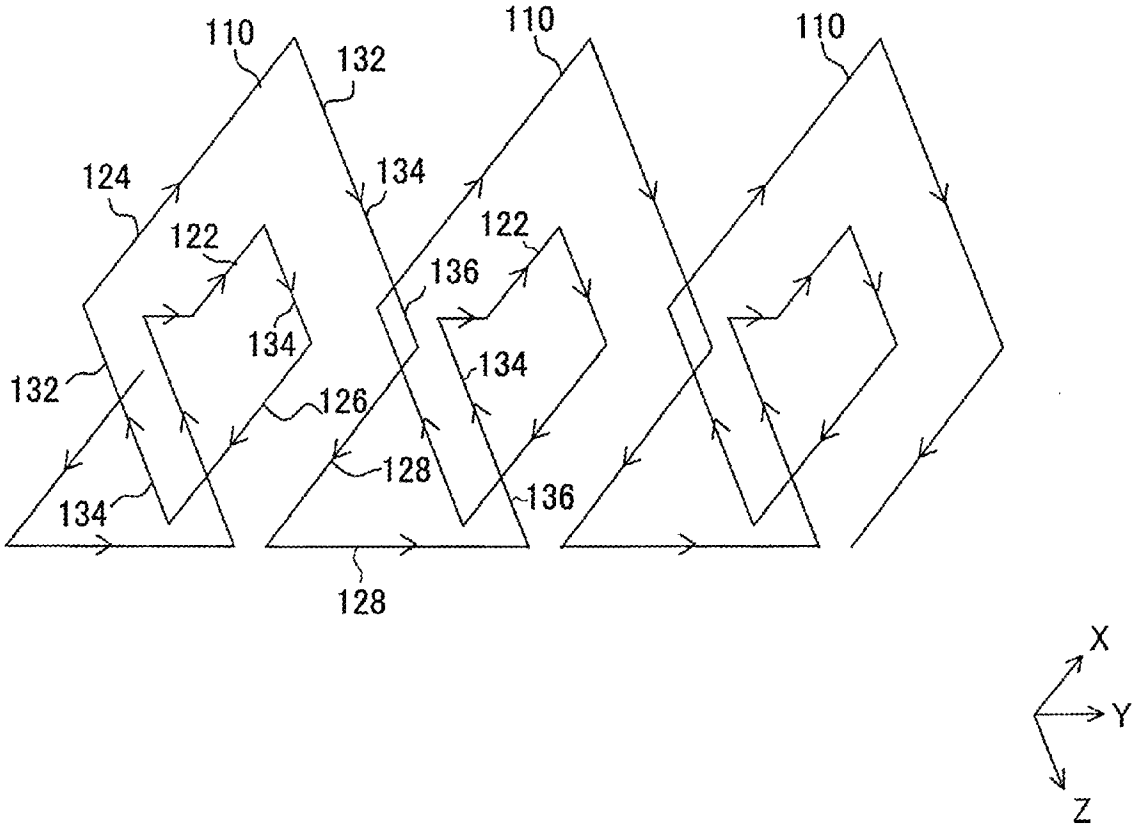
FIG. 12 is a view to illustrate an antenna element according to a modified example of the fourth embodiment.

An antenna device according to a modified example of the fourth embodiment is described by referring to FIG. 12. FIG. 12 schematically shows positions of antenna elements in an antenna device according to the modified example of the fourth embodiment. In the modified example of the fourth embodiment, a multiple-element antenna is structured by joining three spiral antenna elements 110 of the fourth embodiment in a laminated printed wiring board described above with reference to FIG. 11.

As described above with reference to FIG. 11, a single spiral antenna element 110 is formed by positioning the following in a spiral form: first conductive layer 122, via conductor 134, second conductive layer 126, via conductors (134, 132), third conductive layer 124, via conductors (132, 134, 136) and fourth conductive layer 128. Outermost fourth conductive layer 128 is extended in a direction along axis Y to be connected to first conductive layer 122 of adjacent spiral antenna element 110 by means of via conductors (136, 134).

In the modified example of the fourth embodiment, by joining multiple spiral antenna elements in which conductive layers and via conductors are positioned in a spiral form, a multiple-element antenna is structured. Since a multiple-element antenna is made compact and is formed using technology for manufacturing printed wiring boards, such antennas are manufactured at low cost. A highly integrated antenna is achieved by joining multiple elements, and antenna quality is enhanced.

Figure 13:
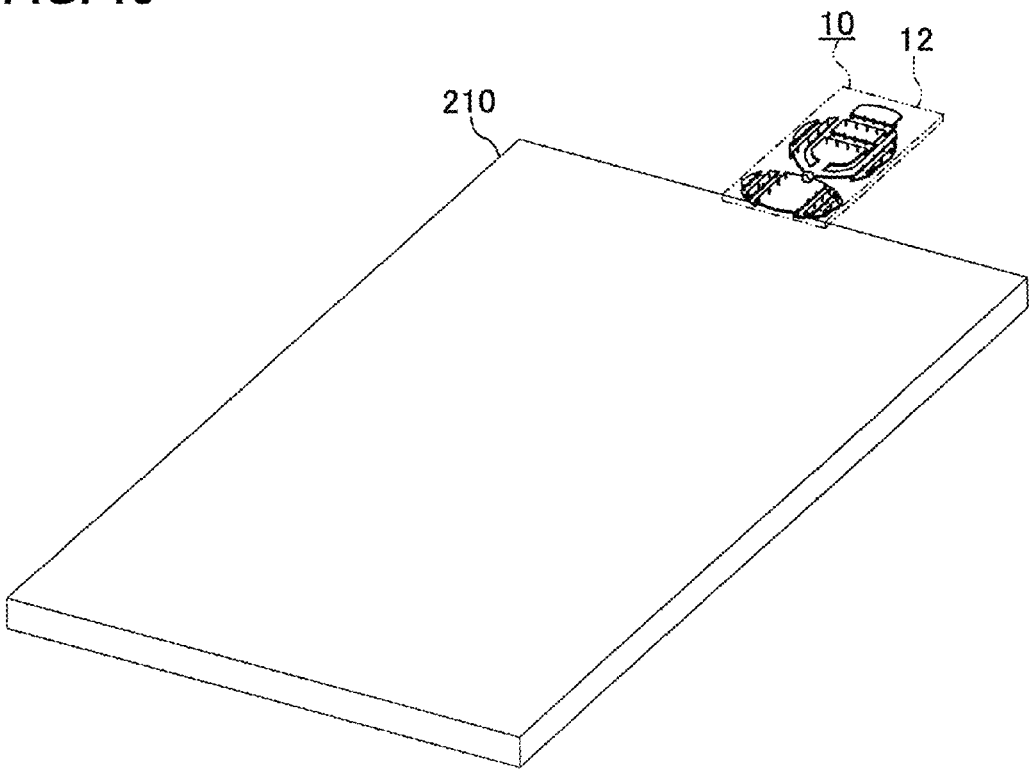
FIG. 13 is a view to illustrate an example of how to load an antenna element.

An example of an antenna device mounted in a printed wiring board is described by referring to FIG. 13. Printed wiring board 12 forming antenna device 10 is a flexible wiring board made of polyimide, Teflon (registered trademark) or the like, and antenna device 10 is positioned on a side of rigid wiring board 210 made of epoxy or the like and is connected to rigid wiring board 210. An end of antenna device 10 is inserted in rigid wiring board 210 from its side, and the wiring of rigid wiring board 210 and the wiring of the antenna device are connected electromagnetically.

Figure 14:
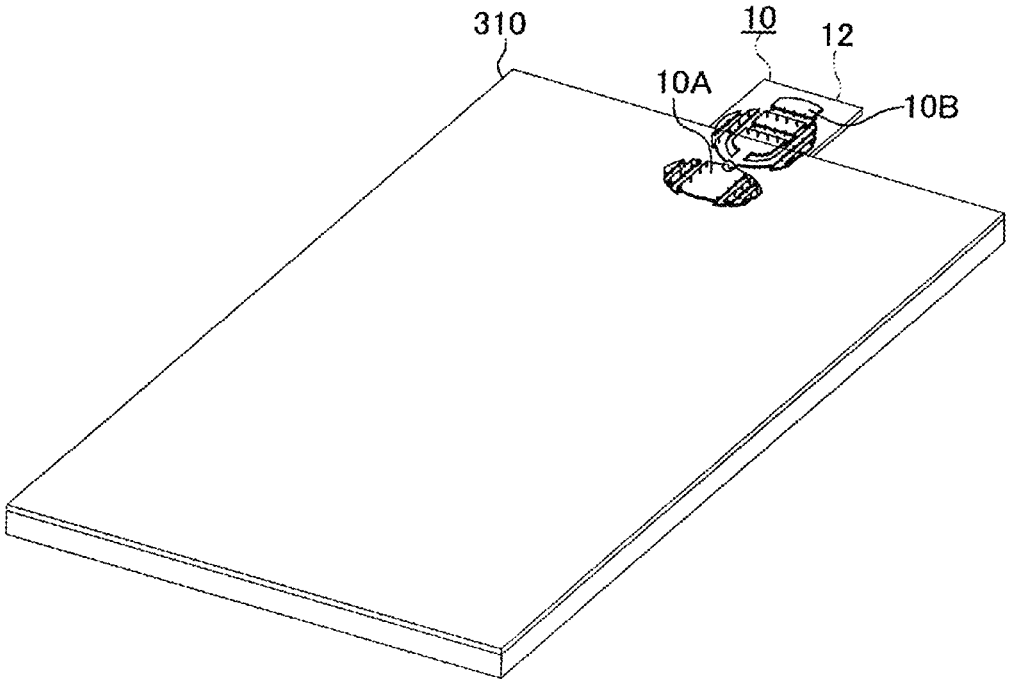
FIG. 14 is a view to illustrate another example of how to load an antenna element.

By referring to FIG. 14, another example of an antenna device mounted in a printed wiring board is described. Antenna device 10 is formed with flex-rigid substrate 12 and includes high-frequency antenna portion (10A), which radiates relatively high-frequency radio waves, and low-frequency antenna portion (10B), which radiates relatively low-frequency radio waves. High-frequency antenna portion (10A) is positioned on rigid substrate 310, and low-frequency antenna portion (10B) is formed on flex-rigid substrate 12.

In the above-described embodiments, through holes may be filled with metal or may be hollow.

An antenna device according to an embodiment of the present invention has the following technological characteristics: a substrate having a first surface and a second surface opposite the first surface; a first-surface-side conductive layer formed on the first surface of the substrate; a second-surface-side conductive layer formed on the second surface of the substrate; and a through hole connecting the first-surface-side conductive layer and the second-surface-side conductive layer. In such an antenna device, the first-surface-side conductive layer, the through hole and the second-surface-side conductive layer are positioned in a crank form seen at a cross section in a longitudinal direction or in a lateral direction.

In the antenna device, an antenna element is formed by positioning multiple first-surface-side conductive layers, through holes and multiple second-surface-side conductive layers in a crank form seen at a cross section. Therefore, such a device is made compact compared with a device where an antenna element is positioned only on the first surface. In addition, by positioning the antenna element in a crank form seen at a cross section, broadband properties are achieved. Since such an antenna is formed by using technology for manufacturing printed wiring boards, the antenna is manufactured at low cost, while it is easy to build the antenna into a mobile terminal since the antenna is accommodated in a printed wiring board. The first-surface-side conductive layers and the second-surface-side conductive layers are planar conductors, and the conductive layers are connected to each other by multiple through holes.

In the antenna device, the antenna element may be formed by using through holes to connect multiple first-surface-side wire portions and multiple second-surface-side wire portions in a helical form. Therefore, a helical antenna is formed in a planar printed wiring board, making the antenna device compact. Since such an antenna is formed by using technology for manufacturing printed wiring boards, such antennas are manufactured at low cost.

The antenna device may include an antenna element formed by positioning in a helical form multiple first-surface-side conductive layers, through holes and multiple second-surface-side conductive layers as well as an antenna element formed by using through holes to connect multiple first-surface-side wire portions and multiple second-surface-side wire portions in a crank form. Accordingly, a compact broadband antenna is achieved.

In the antenna device, the distance may be set to increase between the lines connecting a side of each conductive layer formed continuously on the first-surface side and on the second-surface side of the radiation element and the ground element respectively, as the lines are extended farther from the feed point. Here, at high frequencies exceeding 5 GHz, a waveguide is formed equivalently between the line along the radiation element facing the ground element and the line along the ground element facing the radiation element to determine characteristic impedance. Thus, by positioning those lines in such a way that the distance between them is set to increase gradually, a widening waveguide with a tapered shape is formed and characteristic impedance changes continuously in response to frequencies. Thus, broadband properties are achieved. Furthermore, fluctuations in directivity are minimized when frequencies change.

In the antenna device, a helical antenna element may include a primary element and a turn-back element connected at a short-circuiting point of the primary element, and it makes easy to adjust properties.

The antenna device may include multiple removable short-circuiting points, and it makes easy to adjust properties in each unit by removing a predetermined short-circuiting point using laser trimming.

Conductive layers may be extended beyond a through hole toward their respective adjacent conductive layers, providing conductance between adjacent conductive layers. Since the amount of conductance is adjusted by trimming or the like, it is easy to adjust antenna properties.

In the antenna device, a spiral antenna element may be formed by positioning in a spiral form a first conductive layer, a second conductive layer, a third conductive layer, a fourth conductive layer and via conductors, which are formed in a multilayer printed wiring board containing three insulation layers. Since a spiral antenna element is made compact while such an antenna is formed using technology for manufacturing printed wiring boards, such antennas are manufactured at low cost.

In the antenna device, a multiple-element antenna may be structured by combining multiple spiral antenna elements formed by positioning in a spiral form a first conductive layer, a second conductive layer, a third conductive layer, a fourth conductive layer and via conductors, which are formed in a multilayer printed wiring board containing three insulation layers. Since such a multiple-element antenna is made compact while using technology for manufacturing printed wiring boards, such antennas are manufactured at low cost.

Obviously, numerous modifications and variations of the present invention are possible in light of the above teachings. It is therefore to be understood that within the scope of the appended claims, the invention may be practiced otherwise than as specifically described herein.

What is claimed is:

1. An antenna device, comprising:

a substrate comprising a plurality of insulation layers; and a plurality of antenna elements formed in the substrate such that each of the antenna elements has a spiral form and includes a plurality of conductive layers and a plurality of via conductors, wherein the plurality of conductive layers includes an innermost conductive layer in the spiral form and an outermost conductive layer in the spiral form such that the outermost conductive layer of one of the antenna elements is connected to the innermost conductive layer of another one of the antenna elements adjacent to the one of the antenna elements via a via conductor.

2. The antenna device according to claim 1, wherein the substrate is a flexible wiring board which is positioned to a side of a rigid wiring board and connected to the rigid wiring board.

3. The antenna device according to claim 2, wherein one end of the substrate is inserted in the rigid wiring board.

4. The antenna device according to claim 2, wherein the flexible wiring board has a wiring which is electromagnetically connected to a wiring of the rigid wiring board.

5. The antenna device according to claim 2, wherein the antenna elements are formed in the substrate such that the antenna elements are extending in a direction along an axis perpendicular to the spiral form.

6. The antenna device according to claim 1, wherein the substrate is a flex-rigid wiring board and connected to a rigid wiring board having an antenna device configured to respond to a radio wave in a relatively high frequency band, and the plurality of antenna elements is configured to respond to a radio wave in a relatively low frequency band.

7. The antenna device according to claim 1, wherein the plurality of insulation layers includes a first insulation layer having a first surface and a second surface on an opposite side of the first surface, a second insulation layer laminated on a first-surface side of the first insulation layer, and a third insulation layer laminated on a second-surface side of the first insulation layer, the plurality of conductive layers includes a first conductive layer formed on the first-surface side of the first insulation layer, a second conductive layer formed on the second-surface side of the first insulation layer, a third conductive layer formed on the second insulation layer on an opposite side of the first insulation layer, a fourth conductive layer formed on the third insulation layer on an opposite side of the first insulation layer; and the plurality of via conductors includes a via conductor formed through the first insulation layer and connecting the first conductive layer and the second conductive layer, a via conductor formed through the first insulation layer and a via conductor formed through the second insulation layer such that the second conductive layer is connected to the third conductive layer, and a via conductor formed through the second insulation layer, a via conductor formed through the first insulation layer and a via conductor formed through the third insulation layer such that the third conductive layer is connected to the fourth conductive layer, the first conductive layer, the second conductive layer, the third conductive layer and the fourth conductive layer are positioned and connected via the plurality of via conductors such that the first conductive layer, the second conductive layer, the third conductive layer, the fourth conductive layer and the plurality of via conductors form the spiral form, and the antenna elements are connected such that the fourth conductive layer of one of the antenna elements is connected the first conductive layer of another one of the antenna elements formed adjacent to the one of the antenna elements via a via conductor.

8. The antenna device according to claim 7, wherein the substrate is a flexible wiring board which is positioned to a side of a rigid wiring board and connected to the rigid wiring board.

9. The antenna device according to claim 8, wherein one end of the substrate is inserted in the rigid wiring board.

10. The antenna device according to claim 8, wherein the flexible wiring board has a wiring which is electromagnetically connected to a wiring of the rigid wiring board.

11. The antenna device according to claim 8, wherein the antenna elements are formed in the substrate such that the antenna elements are extending in a direction along an axis perpendicular to the spiral form.

12. The antenna device according to claim 6, wherein the substrate is a flex-rigid wiring board and connected to a rigid wiring board having an antenna device configured to respond to a radio wave in a relatively high frequency band, and the plurality of antenna elements is configured to respond to a radio wave in a relatively low frequency band.

13. The antenna device according to claim 7, wherein the antenna elements are formed in the substrate such that the antenna elements are extending in a direction.

14. The antenna device according to claim 7, wherein the antenna elements are formed in the substrate such that the antenna elements are extending in a direction along an axis perpendicular to the spiral form.

15. The antenna device according to claim 1, wherein the antenna elements are formed in the substrate such that the antenna elements are extending in a direction.

16. The antenna device according to claim 1, wherein the antenna elements are formed in the substrate such that the antenna elements are extending in a direction along an axis perpendicular to the spiral form.

* * * * *